United States Patent [19]

DiMattio

[11] 3,979,157

[45] Sept. 7, 1976

[54] ELECTRON TUBE BASE

[75] Inventor: Louis Joseph DiMattio, Dunmore, Pa.

[73] Assignee: RCA Corporation, New York, N.Y.

[22] Filed: Oct. 10, 1974

[21] Appl. No.: 513,599

[52] U.S. Cl. ..... 339/145 T; 313/318; 339/186 T

[51] Int. Cl.[2] ..... H01R 13/50

[58] Field of Search ..... 339/14 T, 66 T, 143 T, 339/144 T, 144 R, 145 R, 145 T, 155 T, 193 R, 195 L, 206 L, 216 T, 252 T; 313/318

[56] References Cited

UNITED STATES PATENTS 3,278,886 10/1966 Blumenberg et al. ..... 339/145 T 3,771,105 11/1973 Yamazaki et al. ..... 339/66 T X

*Primary Examiner*—Roy Lake
*Assistant Examiner*—E. F. Desmond
*Attorney, Agent, or Firm*—Glenn H. Bruestle; George E. Haas

[57] ABSTRACT

A hollow cylindrical insulating body has external longitudinal grooves and aligned apertures with tapered ends to receive the stem leads from an electron tube and support the inner sides thereof. The inner surface of the grooves has two guide tracks with inclined ends to facilitate application and removal of the socket.

2 Claims, 8 Drawing Figures

ELECTRON TUBE BASE

BACKGROUND OF THE INVENTION

The present invention relates to electron tube bases and particularly to those for electron tubes having a relatively small diameter neck. The improved base is particularily useful in color picture tubes of the plural beam shadow mask type, but the invention cam be used in any electron tube wherein a small stem with a large exhaust tubulation is desired, e.g., in large power tubes.

In most of the rectangular, 110° deflection, color picture tubes presently in use, the triple beam electron gun is mounted in a tubular glass neck having an O.D. of about 1⅛ inches and terminating at an annular transverse wall, through which 12 stiff leads extend in a circle and from which a central exhaust tubulation extends.

The small diameter of the tube neck presented problems with respect to the protection of the leads from accidental bending during shipment and storage. In addition, with the smaller tube neck, the leads were in closer proximity to one another and protection from surface leakage had to be provided. The conventional tube bases, such as shown in U.S. Pat. No. 3,219,965 issued Nov. 23, 1965 to Joseph B. D'Adamo, which were essentially caps through which the leads extended, did not provide a solution. In response to these unsolved problems, the tube base was modified as evidenced by Canadian Patent No. 928,761 issued on June 19, 1973 to Richard H. Hughes. The modified base was a hollow cylinder with external longitudinal grooves having semicircular channels, extending the full length of the groove. The tube leads would fit within the channels after the base was assembled on the socket. The portion of the cylinder between the grooves protected the pins from damage and electrically insulated them from one another. The matching socket had 12 spring contacts corresponding to the 12 leads. When the socket was slipped on the base, the contacts initially slid on the bottom of the groove which formed the rim of the channel. When the spring impinged the lead, it would rise onto the lead.

However, problems developed with the use of these modified bases. Removal of the socket from the base often pulled the base from the tube neck. Investigation disclosed that during removal, the spring contact in the socket would slip from the bottom of the groove into the channel and wedge against the channel walls. This wedging in essence would lock the base on to the socket causing both to be pulled off the tube neck.

SUMMARY OF THE INVENTION

The present invention is an improved electron tube base having a hollow cylindrical body of insulating material. The exterior surface of the body has a series of longitudinal grooves commencing at one end of the body and extending for most of its length terminating in a closed end. The other end of the body has a plurality of apertures extending therethrough; each one opening into a different groove. Each groove contains two spaced raised tracks extending from the closed end of the groove along each wall for less than the entire length of the groove.

BRIEF DESCRIPTION OF THE DRAWINGS

In the appended drawings.

DETAILED DESCRIPTION OF THE INVENTION

Figure 1:
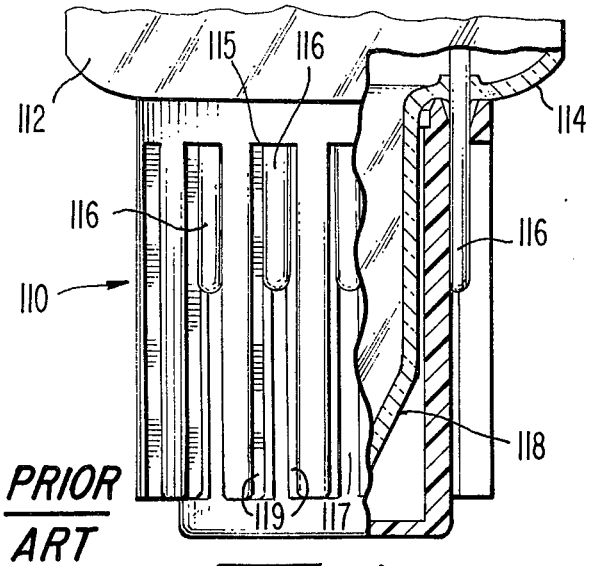
PRIOR ART Fig. 1
FIG. 1 is a side view, partly in axial section, of a prior art electron tube neck and base assembly.

The prior art displayed in FIG. 1, shows a narrow glass tube neck 112, tube wall 114 with stiff leads 116 extending therethrough and exhaust tubulation 118. Cylindrical base 110 includes grooves 115 with bottom surfaces 119 and semicircular channels 117 in which leads 116 are located. It should be noted that the channels 117 run the full length of grooves 115.

Figure 2:
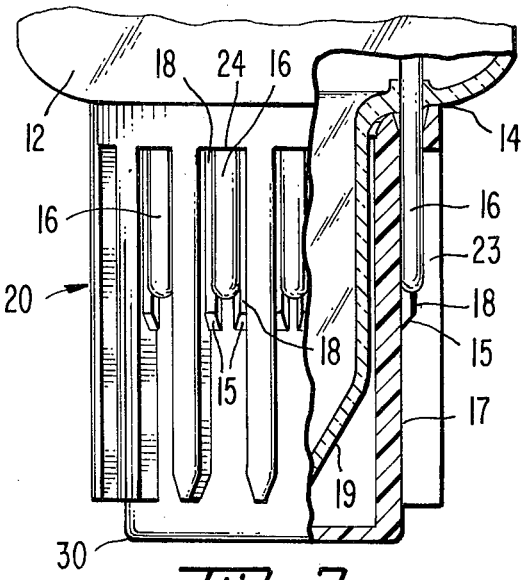
FIG. 2 is a view, similar to FIG. 1 and to the same scale, of a neck-base assembly according to the present invention.
Figure 3:
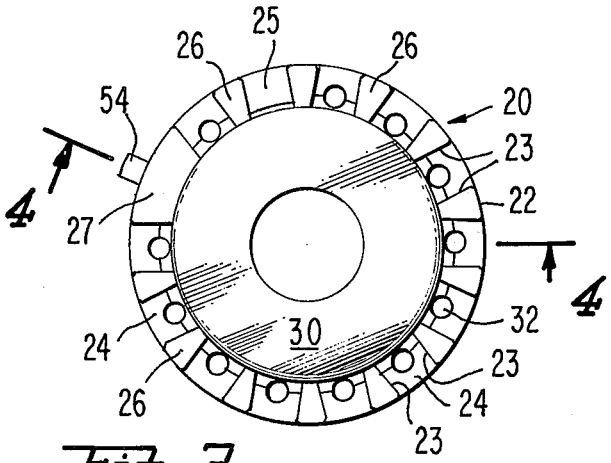
FIG. 3 is a plan view of the lower or outer end of the base of FIG. 2.
Figure 5:
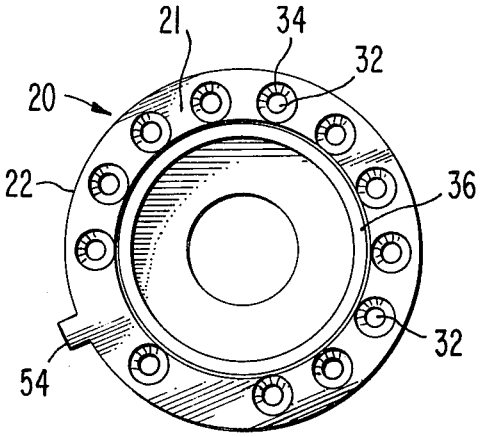
FIG. 5 is a plan view of the upper end of the base of FIG. 2.
Figure 4:
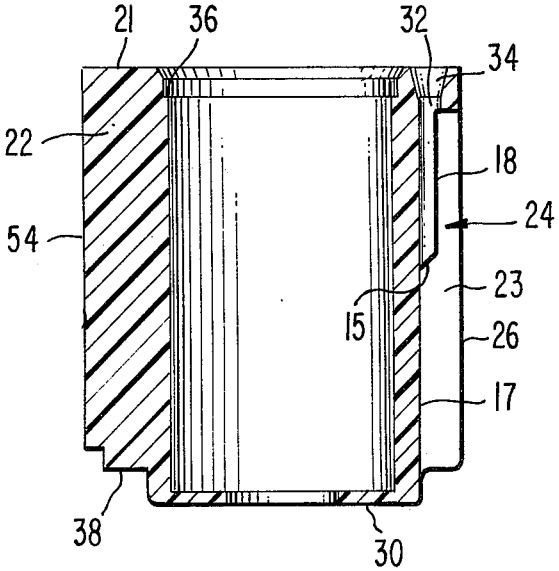
FIG. 4 is an axial section view taken on the line 4—4 of FIG. 3.

FIG. 2 shows a narrow glass tube neck 12 having tube wall 14 on which improved base 20 is mounted. Base 20, shown more in detail in FIGS. 3–5, comprises a hollow cylindrical body 22 molded of insulating plastic. The outer surface of body 22 is formed with 12 longitudinal grooves 24 extending from lower end 30 of body 22 to a point adjacent to but spaced from upper end 21, terminating in a closed end. Each groove 24 has two longitudinal walls 23, a bottom surface 17 between said walls and two raised guide tracks 18 on the bottom surface. Each track 18 extends longitudinally from the closed end of the groove along one wall 23 for a distance less than the entire length of the groove 24 at which point it is terminated by an incline 15 from bottom surface 17 to the surface of raised tracks 18. Cylindrical body 22 also includes one blank groove 25 which does not contain raised tracks in its bottom surface. Grooves 24 and 25, have equal width and length forming 12 identical ribs 26 and one wide rib 27. Rib 27 may include an optional longitudinal key 54. The upper end 21 of body 22 includes an interior annular recess 36 and 12 apertures 32 with tapered entrance portions 34. Each aperture 32 extends from the upper end 21 to a different groove 24. The lower end 30 may be formed with an external annular recess 38.

Figure 6:
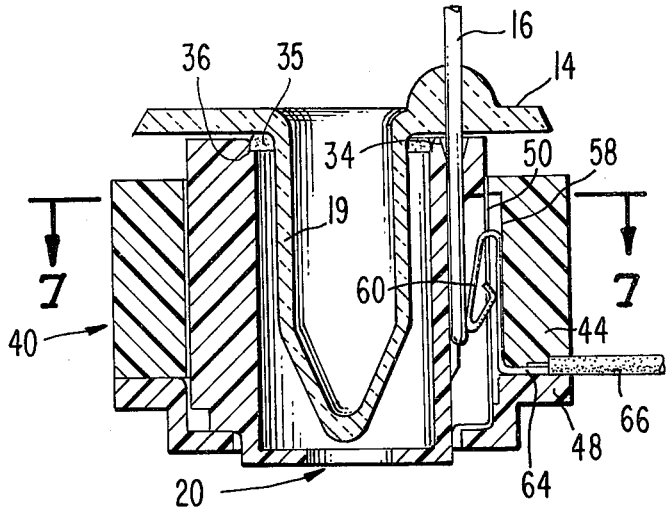
FIG. 6 is an enlarged axial section view of an assembled neck, base and socket.

The tube neck 12 includes a wall 14 having an exhaust tubulation 19, 12 lead positions with leads 16 and two blank lead positions (not shown). When the base 20 is assembled on tube wall 14, as shown in FIGS. 2 and 6, leads 16 extend through apertures 32 and rest between raised tracks 18 in grooves 24. The raised tracks 18 terminate a short distance beyond the ends of leads 16. Exhaut tubulation 19 fits within the inner diameter of hollow cylindrical body 22. Blank groove 25 and wide rib 27 correspond to the two blank lead positions on wall 14. The ribs 26 and 27 protect leads 16 from accidental damage as well as providing surface leakage insulation between the leads, especially between the high voltage lead 33 and the adjacent leads 16, FIG. 7. The base 20 is fastened to neck 12 by a conventional adhesive 35 applied into recess 36.

Figure 7:
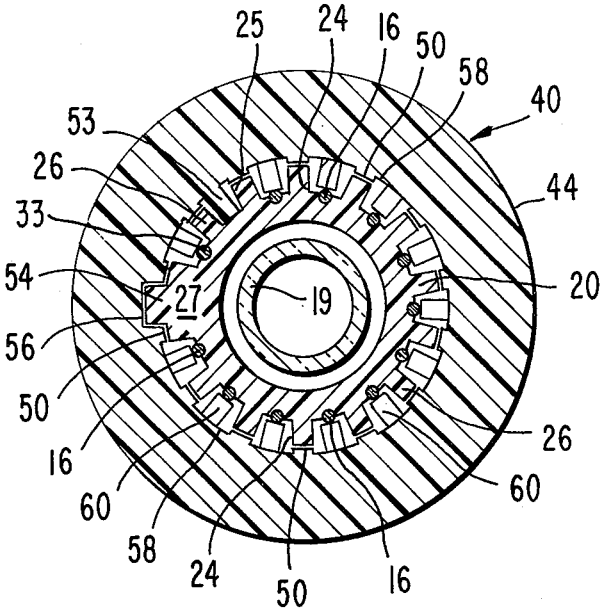
FIG. 7 is a transverse section view taken on line 7—7 of FIG. 6.

The matching socket 40, shown in FIGS. 6 and 7 assembled with wall 14 and base 20, comprises a hollow cylindrical portion 44 and an annular cover plate 48. Cylindrical portion 44 is formed with 12 axially extending internal ribs 50 and one wide internal rib 53 with channels 58 between the ribs. Spring contacts 60 are contained within channels 58 and have a short leg 64 and lead wire 66 sandwiched between portion 44 and cover plate 48. Each spring contact 60 is normally biased radially inward so that when the socket and base are assembled, the contacts will engage the outer sides of leads 16. The socket 40 may also include a keyway 56, corresponding to key 54 on base 20.

When the socket and base are assembled, internal ribs 50 on socket portion 44 fit against base ribs 26 and 27 and the wide internal socket rib 53 fits into blank base groove 25 providing additional protection against surface leakage. Due to the presence of the wide rib 27 on base 20 and socket rib 53, the socket and the base can be assembled in only one angular relationship. The optional key 54 and keyway 56 also prevent incorrect assembly. The upper end of rib 53 contacts the closed end of groove 25 to act as a stop during assembly of the socket onto the base.

Figure 8:
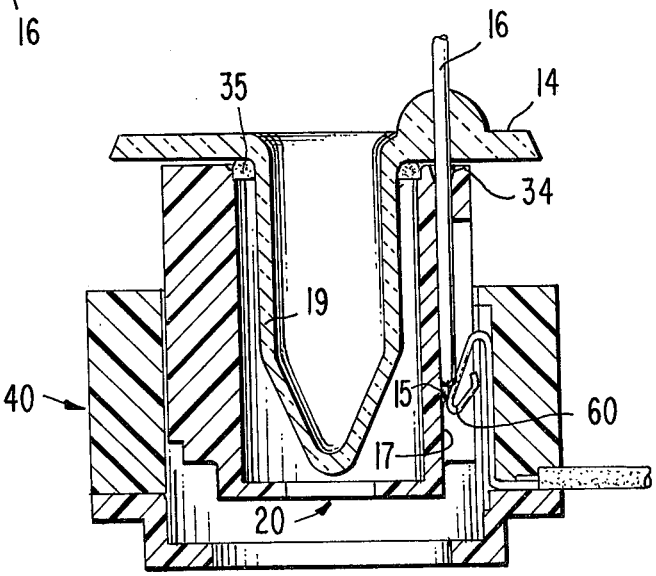
FIG. 8 is an axial section view similar to FIG. 6 showing the socket and base in an intermediate position of assembly.

In assembling socket 40 onto base 20 the contacts 60 initially ride on the bottom surfaces 17 of grooves 24 until contacting the inclines 15 whereupon said spring contacts slide up said inclines and are compressed as shown in FIG. 8. The spring contacts 60 continue to slide up the inclines and onto leads 16 reaching the position shown in FIG. 6. The reverse process occurs during removal of socket 40.

By shortening the length of channels 117 (FIG. 1) of the old style base and by including an incline, the assembly and disassembly of the socket and base is facilitated. The inclined tracks decrease the amount of force necessary in inserting the socket. The compression of the twelve spring contacts is gradual and less abrupt than where there is no incline and the contacts have to ride up the relatively blunt end of the leads. The inclusion of the incline has reduced the insertion force an average of 27.8 percent from 7.2 pounds with the old base to 5.2 pounds with the improved base. The possibility that the contacts will wedge into the channel walls during extraction has been eliminated in the improved base. Since the contacts never slide on the top surface of the raised tracks but only on the incline, the contacts cannot slip into the region between the tracks and lock the socket onto the base. The force necessary to remove the socket from the improved base averages 4.0 pounds or a 29.8 percent decrease from the 5.7 average with the older base style.

What is claimed is:

1. A base for an electron tube comprising:

a hollow cylindrical body of insulating material;

a plurality of longitudinally extending grooves in the outer surface of the body, said grooves extending from one end of said body to a closed end point spaced from the other end of said body, said grooves having two longitudinal walls and an inner groove surface between said walls;

a plurality of apertures extending through said body from the other end thereof to said grooves with each of said apertures opening into a separate one of said grooves; and a pair of spaced raised guide tracks in each of said grooves, each of said guide tracks extending longitudinally from said closed end point of the groove along one of said walls for a length less than the length of said groove and terminating in an exposed end point within the groove, the exposed end points of said guide tracks being inclined from the inner groove surface to the surface of the raised tracks.

2. An electron tube comprising:

an enclosed envelope having an exhaust tubulation and a plurality of stiff electrical leads extending through the envelope in a circle about said exhaust tubulation; and an electron tube base comprising a hollow cylindrical body of insulating material, a plurality of longitudinal grooves in the outer surface of the body extending from one end of said body to a closed end point spaced from the other end of said body, said grooves having two longitudinal walls and an inner groove surface between said walls, a plurality of apertures extending through said body from the other end thereof to said grooves with each of said apertures opening into a separate one of said grooves, and a pair of spaced raised guide tracks in each of said grooves, each of said guide tracks extending longitudinally from said closed end point of the groove along one of said walls for a length less than the length of said groove and terminating at an exposed end point within the groove, the exposed end point inclining from the inner groove surface to the surface of the raised guide tracks;

said electron tube base surrounds the exhaust tubulation and is secured to said enclosure with said electrical leads extending through said apertures and into the grooves, each lead fitting between the raised guide tracks within its respective groove and being of a length so that the lead does not extend beyond the ends of said guide tracks.

* * * * *